United States Patent [19]

Fouladian

[11] Patent Number: 4,899,449

[45] Date of Patent: Feb. 13, 1990

[54] DRAFTING INSTRUMENT

[76] Inventor: Simon Fouladian, 24 Estates Ter. North, Manhasset, N.Y. 11030

[21] Appl. No.: 251,110

[22] Filed: Sep. 29, 1988

[51] Int. Cl.[4] ..... B43L 9/04

[52] U.S. Cl. ..... 33/27.03; 33/565

[58] Field of Search ..... 33/27.03, 26, 422, 1 N, 33/565, 562, 435, 431, 27.11

[56] References Cited

U.S. PATENT DOCUMENTS

| | | | |
|---|---|---|---|
| 2,624,117 | 1/1953 | Paci | 33/27.03 |
| 2,958,132 | 11/1960 | Haptbauer et al. | 33/27.03 |
| 4,175,330 | 11/1979 | Hermann | 33/27.03 |

FOREIGN PATENT DOCUMENTS

| | | | |
|---|---|---|---|
| 0191702 | 8/1986 | European Pat. Off. | 33/569 |
| 509361 | 1/1955 | Italy | 33/474 |
| 0746099 | 3/1956 | United Kingdom | 33/27.03 |

*Primary Examiner*—Harry N. Haroian

[57] ABSTRACT

This invention relates to a novel design of a drafting instrument capable of assisting in the accurate drafting of arches, circles, as well as the measurement of angular relationships, and the like, whereby a base plate defines a circular opening having a cover plate symmetrically positioned about the perimeter of the opening formed in said base plate, there being symmetrically positioned about the center of the opening formed within the base plate a series of gear members such that upon the placement of a templet member whose dimensions are such as to have its perimeter come into mechanical contact with each of the gear members there is achieved a unique and novel means of positioning the templet member about the surface of a drawing while providing a mechanically accurate means to rotate said templet member about its center axis. By utilizing a templet having preconceived openings formed through its surface capable of receiving the point of a pencil or pen, there is achieved a means to accurately draw upon a surface arches, circles, and the like, as well as to achieve the measuring of angular relationships.

7 Claims, 3 Drawing Sheets

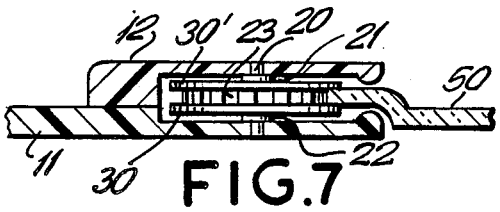
FIG.7
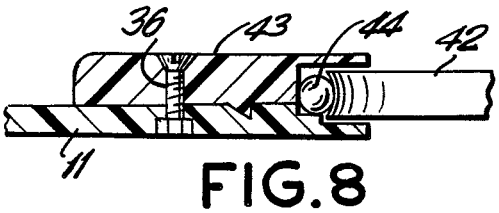
FIG.8
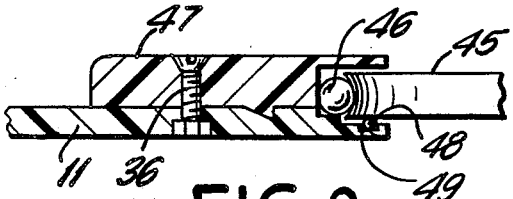
FIG.9
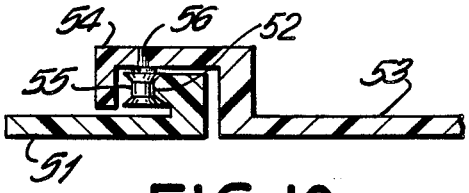
FIG.10
FIG.11
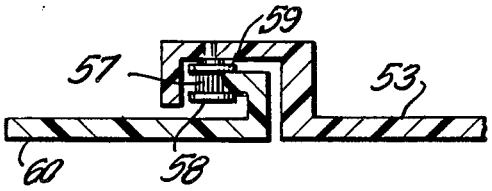
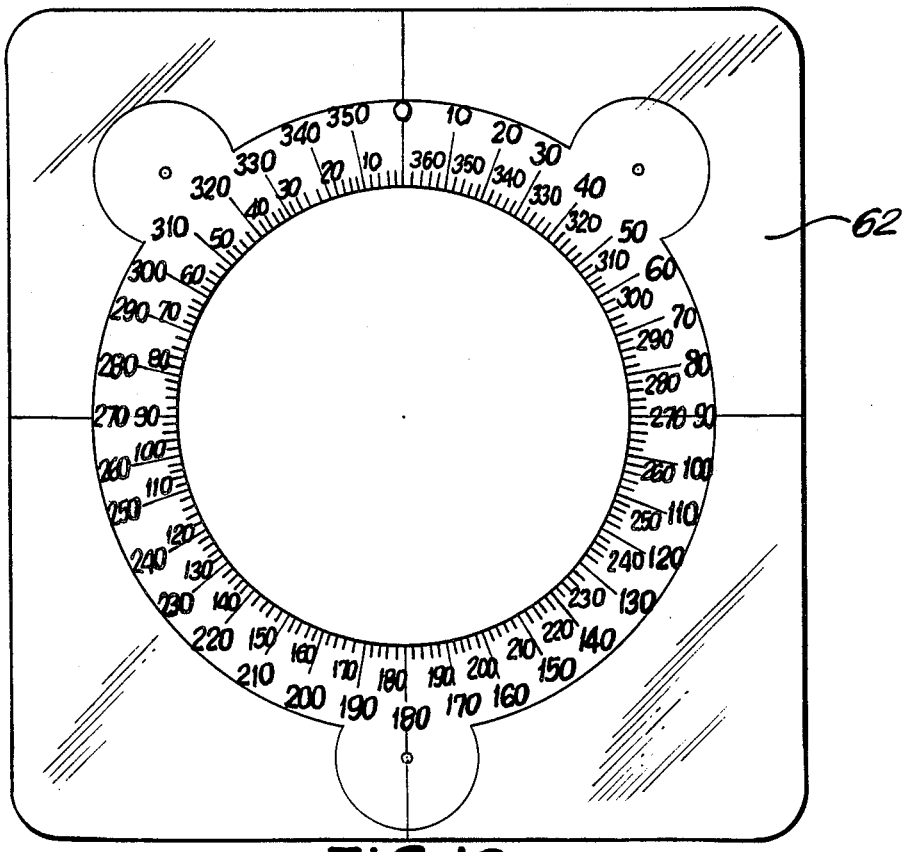
FIG.12

DRAFTING INSTRUMENT

BACKGROUND AND OBJECTS OF THE INVENTION

With regard to present drafting techniques and implements utilized to accomplish various drafting tasks, although a variety of such instruments exist in the prior art, non are able to achieve the overall accomplishments and efficiencies associated with the present invention, said prior art devices thereby failing to achieve the flexibility and overall achievements accomplishable by the utilization of the present invention.

More particularly, various drafting instruments are known in the prior art in conjunction with the utilization of a templet, and the like, or otherwise, which are capable of enabling draftmen to draw an arch, a circle, and the like, as well as to measure angular relationships, some examples of such prior art devices as related to the above, being as follows, to wit, a patent issued to Stober, Jr. et al, U.S. Pat. No. 3,791,036, entitled DRAFTING INSTRUMENT; a patent issued to Corrington et al, U.S. Pat. No. Des. 254,855, entitled COMPASS; U.S. Pat. No. 3,795,053, entitled COMBINATION DRAFTING INSTRUMENT; a patent issued to Kamila, U.S. Pat. No. Des. 251,252, entitled BEAM COMPASS; a patent issued to Kuwada, U.S. Pat. No. 3,738,009, entitled RULE AND COMPASS DEVICE; patent issued to Fisher, U.S. Pat. No. 3,465,445, entitled DRAWING AND DESIGN APPARATUS OR INSTRUMENT; a patent issues to Konrad, U.S. Pat. No. 4,589,210, entitled METHOD AND MEANS FOR CENTERLESS CIRCLE CONSTRUCTION; a patent issued to Hermann, U.S. Pat. No. 4,175,330, entitled ADJUSTABLE COMPASS DEVICE; a patent issued to Hatter, et al, U.S. Pat. No. 4,129,948, entitled CIRCLE DRAWING AND MEASURING DEVICE; a patent issued to Lopez, U.S. Pat. No. Des. 252,615, entitled COMBINED PROTRACTOR, TRIANGLE, COMPASS AND BEAM COMPASS.

Although the prior art devices and techniques have existed to assist a draftman in the drawing of arches, circles, measuring of angular relationships, and the like, the present invention relates to a novel design of a device that provides unique advantages in achieving the above while overcoming a number of disadvantages inherent in said prior art device.

It is, therefore, an object of the present invention to create a novel design for a drafting instrument that overcomes the various problems and disadvantages inherent in the prior art devices to date.

It is another object of the present invention to create a novel design for a drafting instrument whereby there is avoided the necessity to cause the placement of an anchoring point through the center of the templet utilized in conjunction with said drafting instrument to enable the drawing of a particular arch and/or circle.

It is another object of the present invention to create a novel design for a drafting instrument whereby there is achieved through the utilization of symmetrically positioned gear members about the perimeter of the opening formed about the center of said drafting instrument a means to avoid contact between the surface of the paper upon which said drafting is being performed and the surface of the templet utilized in conjunction with said drafting instrument.

It is another object of the present invention to create a novel design for a drafting instrument whereby there is achieved the ability to avoid deviation of said templet from its center point in relationship to the paper upon which drafting is occurring without the necessity of causing a positioning pin to pass through said templet center point and into the surface of said paper.

It is another object of the present invention to create a novel design for a drafting instrument whereby there is achieved the ability to readily enable the interchange of various templets with the overall structure of said drafting instrument so as to accomplish a variety of drafting tasks.

It is another object of the present invention to create a novel design for a drafting instrument whereby said device is of a simple and unitary structure, inexpensive to manufacture, durable and accurate.

It is another object of the present invention to create a novel design for a drafting instrument whereby there is achieved a drafting instrument capable of accomplishing a variety of tasks simply by the interchange of templet members whose pre-design is capable of implementing said functions.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements herein shown and described.

BRIEF DESCRIPTION OF THE DRAWINGS

FIG. 7 is a partial cross-sectional view of a drafting instrument similar to that depicted in FIG. 6 and illustrative of an alternative embodiment of the invention.

FIG. 8 is a partial cross-sectional view of a drafting instrument similar to that depicted in FIG. 4 but illustrative of an alternative embodiment thereof.

FIG. 9 is a partial cross-sectional view of a drafting instrument similar to that depicted in FIG. 4 but illustrative of an alternative embodiment thereof.

FIG. 10 is a partial cross-sectional view of an alternative embodiment of the invention evidencing an alternative mechanical interrelationship between the base plate of said alternative embodiment of said drafting instrument with a templet member.

FIG. 11 is a partial cross-sectional view of a drafting instrument similar to that depicted in FIG. 8 but illustrative of an alternative embodiment thereof.

FIG. 12 is a top elevational view of an alternative embodiment of the invention wherein the base plate is constructed in accordance with the invention for utilization as a protractor.

DESCRIPTION OF A PREFERRED EMBODIMENT

Figure 1:
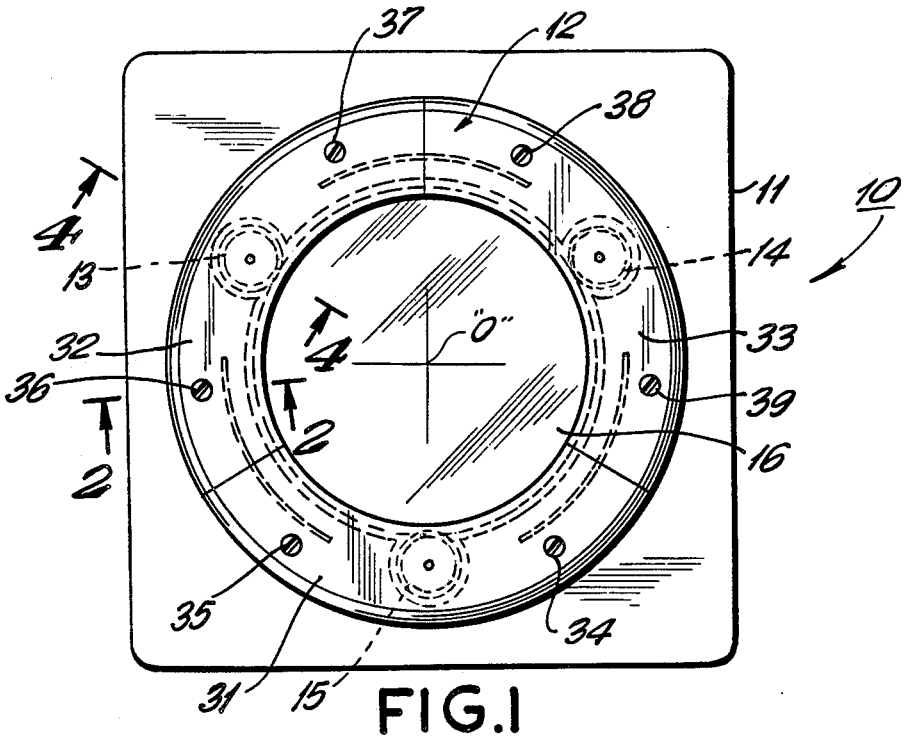
FIG. 1 is a top elevational view of a drafting instrument constructed in accordance with the invention.

Reference is herein made to FIG. 1 wherein there is set forth a preferred embodiment of the invention, wherein, there is generally depicted drafting instrument 10 fabricated and otherwise constructed in accordance with the invention.

More particularly, as therein illustrated, drafting instrument 10 comprises a base plate 11 that has formed symmetrically about its center point a circular opening. Base plate 11, in accordance with the invention, can be constructed from any one of a number of well known substances, be they metallic, plastic, and/or the like, it being within the scope of this invention that base plate 11 can be fabricated from any one of a number of known materials as long as same evidences a structural integrity sufficient to provide a uniform flat plane or surface which will not become distorted through the utilization of drafting instrument 10.

As further depicted in FIG. 1, cover plate 12 is structurally affixed to base plate 11 symmetrically about the opening center in base plate 11, cover plate 12 also being fabricated from a material identical to that which may be utilized with regard to the construction of base plate 11.

In keeping with the invention and as set forth in FIG. 1, it should be noted that cover plate 12 consists of three separate and distinct plate members (or more as the case may be), to wit, plate member 31, 32 and 33 respectively which upon mechanical affixing to base plate 11 by utilization of screw members 34, 35, 36, 37, 38 and 39 respectively mechanically interreact so as to define cover plate 12 in such a fashion as to impart to the device a mechanical interrelationship between cover plate 12 and base plate 11 as if cover plate 12 was of a unitary construction and not comprising three separate and distinct members.

As depicted in FIG. 1, plate member 31 is structurally affixed to base plate 11 by use of screw members 34 and 35 respectively. Similarly, plate member 32 is structurally affixed to base plate 11 by use of screw members 36 and 37 respectively. Additionally, plate member 33 is structurally affixed to base plate 11 by use of screw members 38 and 39 respectively.

As can readily be seen and in accordance with the invention, templets are able to be readily interchanged as will be more fully set forth hereinafter upon removing of any two plate members 31, 32 and 33 through unfastening of their respective screw members.

As depicted in FIG. 1, there is symmetrically positioned about the opening formed in base plate 11 mounting member assemblies 13, 14 and 15 respectively, same being structurally affixed to base plate 11 and cover plate 12 so as to provide a means to structurally hold templet member 16 within the opening formed in base plate 11 while allowing the said templet member 16 to freely rotate about its center point in a selective manner, the center point of templet member 16 coinciding with the center of the opening formed in base plate 11 as a result of the fact that the center point of the circle that passes through the points of contact of mounting member assemblies 13, 14 and 15 coincides with the center points of templet 16 once templet 16 is inserted into drafting instrument 10, said center points being designated in FIG. 1 as point designation "0".

Figure 2:
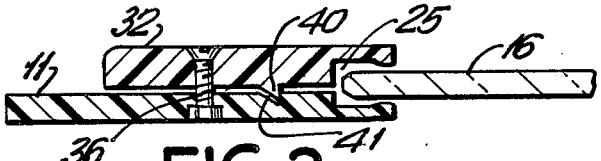
FIG. 2 is a partial cross-sectional view taken along lines 2—2 of the drafting instrument depicted in FIG. 1.

In keeping with the invention, reference is herein made to FIG. 2 wherein there is depicted a partial cross-sectional view of FIG. 1 taken along lines 2—2 thereof wherein there is depicted, in the preferred embodiment of the invention, the structural interrelationship between base plate 11 and plate member 32 of cover plate 12, plate member 32 being fastened to base plate 11 by means of screw member 36. In keeping with the invention, it should further be noted that any mechanical equivalent fastening means can be utilized in place of screw member 36 and still be within the scope of the invention.

As depicted in FIG. 2, screw member 36 is recessed with the structure of base plate 11 and plate member 32 of cover plate 12 so that there does not occur a protrusion of any portion of screw member 36 above the planar surface of either base plate 11 or plate member 32 of cover plate 12. As further depicted in FIG. 2, templet member 16 is depicted in accordance with the invention positioned such that its outer extremity is positioned the portions of base plate 11 and plate member 32 of cover plate 12 within defined recess 25.

In further keeping with the invention and as depicted in FIG. 2, plate member 32 of cover plate 12 has formed about its lower surface angle member 40 which is aligned in structural compatibility with recess 41 formed in the surface of base plate 11 such that upon the tightening of screw member 36 as therein depicted, the lower surface of plate member 32 of cover plate 12 comes into contact with the upper planar surface of base plate 11 while angle member 40 is received by recess 41, the interreaction between angle member 40 and recess 41 being such as to cause plate member 32 of cover plate 12 to evidence an inward force directed towards center point "0" of the circle that is defined by the circular arch that passes through all of the centers of the pulley members that are utilized in accordance with the invention and as depicted in FIG. 1, as related to the pulley members depicted as related to mounting member assemblies 13, 14 and 15. In this fashion, there is achieved the ability to provide a means to structurally maintain in a predetermined position templet 16 as related to its contact with pulley member 19.

As depicted in FIG. 2, templet member 16 evidences a templet not designed for utilization with inking implements. In conjunction therewith, reference is herein made to FIG. 3 wherein there is depicted the utilization of an inking templet member 18 in place of templet member 16 as depicted in FIG. 2.

Figure 3:
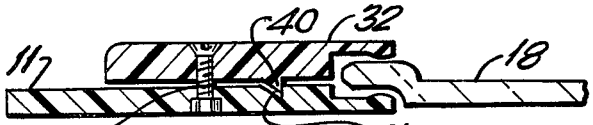
FIG. 3 is a partial cross-sectional view similar to FIG. 2 but indicative of an alternative embodiment of the invention.

As depicted in FIG. 3, the utilization of inking templet member 18 functionally as it mechanically interacts with the component members of drafting instrument 10 is identical to the functional implementation of templet member 16 (FIG. 2), the only difference being that inking templet member 18 has its lower surface positioned closer to the surface upon which drafting is being drawn, same being desirable when inking is being performed as same, as is well known in the prior art, provides for a less awkward means to accomplish the inking process and affords a less prone set of circumstances to have smudging, line width variations and the like occur.

Figure 4:
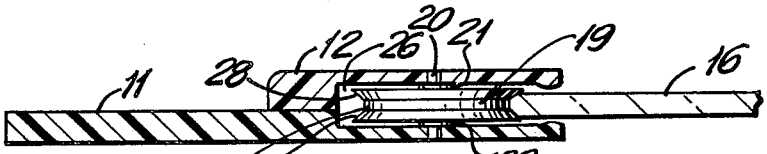
FIG. 4 is a partial cross-sectional view taken along lines 4—4 of the drafting instrument depicted in FIG. 1.

In further keeping with the invention, there is depicted in FIG. 4 a partial cross-sectional view of drafting instrument 10 as depicted in FIG. 1 taken along line 4—4 thereof. As set forth in FIG. 4, there is formed between base plate 11 and cover plate 12 cavity opening 26 in which mounting member assembly 13 is structurally positioned.

As set forth in FIG. 4, mounting member assembly 13 comprises pulley member 19, axially mounted upon shaft member 20 which is structurally fitted to cover plate 12 and base plate 11 respectively as in FIG. 4, there being axially mounted about shaft member 20 between pulley member 19 and cover plate 12 spacer member 21 while there additionally is axially mounted about shaft member 20 between pulley member 19 and base plate 11 spacer member 22, the above structurally interrelationship resulting in the structurally mounting of pulley member 19 within cavity opening 26 in such a fashion as to permit the free rotational movement of pulley member 19 about shaft member 20.

As further depicted in FIG. 4, and in keeping with the invention, pulley member 19 defines an interior recess 27 bordered on each side by a slanted wall member 28 and 29 respectively so as to define a channel into which the outer edge of templet member 16 compatibly mechanically interacts in a complimentary compatible fashion in keeping with the invention and as depicted in FIG. 4, the mechanical interaction between pulley member 19 and templet member 16 is such that both templet member 16 and pulley member 19 are free to rotationally move about their respective axes while the outer portion of templet member 16 rides within the channel formed about the circumference of pulley member 19, there being additionally imparted by said mechanical interrelationship between pulley member 19 and templet member 16 a centripetal force against templet member 16 that aligns with its center axis.

As a result of the above interrelationship between mounting member assembly 13 and templet member 16 as depicted in and as discussed with FIG. 4 and due to the fact that, as depicted in FIG. 1, there may be but is not of necessity symmetrically positioned about drafting instrument 10, a minimum of three such mounting member assemblies, to wit, mounting member assembly 13, mounting member assembly 14 and mounting member assembly 15, there is achieved the ability to maintain the centralized positioning of templet member 16 within precise relationship to base plate 11 such that the center point "0" of templet member 16 independent of its rotational positioning about its axis within drafting instrument 10 remains constant.

As a result, there is achieved, in accordance with the invention, one of the advantages of the present invention not available in the prior art. More particularly, there is achieved the placement of the center point of drafting instrument 10 at a predetermined designation in relationship to the underlying surface upon which drafting is to occur and a posturing of same such that no deviation of said center point will occur while the drafting process is conducted with the utilization of templet member 16, all of the above occurring without the necessity of causing an opening or other mechanical means to pass through templet member 16 and into the underlying surface as a means of anchoring drafting instrument 10.

Figure 5:
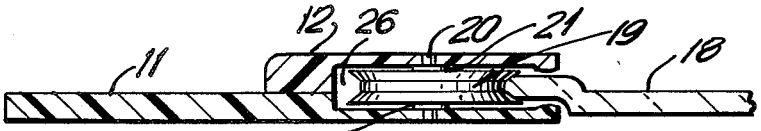
FIG. 5 is a partial cross-sectional view similar to FIG. 4 but indicative of an alternative embodiment of the invention.

In accordance with FIG. 5, there is depicted the utilization of an alternative templet member, to wit, inking templet member 18, in place of templet member 16, the mechanical interrelationship of inking templet member 18 with pulley member 19 as depicted in FIG. 5 is identical to the mechanical interrelationship set forth above when discussing templet member 16 in relationship to pulley member 19 as illustrated in FIG. 4.

Figure 6:
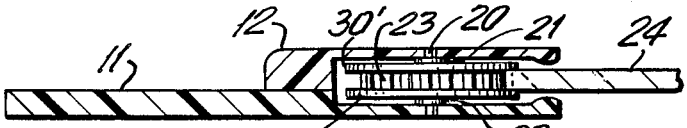
FIG. 6 is a partial cross-sectional view of a drafting instrument similar to that depicted in FIG. 4 but illustrative of an alternative embodiment thereof.

Reference is now herein made to FIG. 6 wherein there is depicted an alternative embodiment of pulley member 19 and templet member 16 as set forth above with regard to FIG. 2 and FIG. 4. More particularly, there is depicted in FIG. 6 in place of pulley member 19, gear member 23 which has about its circumference a toothed gear structure well known within the prior art, said gear member 23 having its toothed circumference mechanically compatible so as to mechanically interfit with templet member 24 whose circumference is also formed so as to define a toothed structure capable of meshing with the toothed structure of gear member 23.

As a result, and due to the meshing of the respective toothed structures of gear member 23 and templet member 24, the mechanical interrelationship between said components does not rely upon a fractional relationship as would be the case with regard to operation of pulley member 19 with templet member 16 as depicted in FIG. 4 or pulley member 19 with inking member 18 as depicted in FIG. 5, but rather, said mechanical relationship between gear member 23 and template member 24 as depicted in FIG. 6 relies upon the structural interfit between said components respective gear structures.

Additionally, as depicted in FIG. 6, gear member 23 has formed about its upper and lower portion, pedestal portions 30 and 30', said pedestal portions 30 and 30' defining a structured space within which templet member 24 rides. In this manner, there is provided at the location of gear member 23 a means to structurally support above the surface of the medium upon which drafting is to occur templet member 24.

Reference is now herein made to FIG. 7 wherein there is depicted a partial cross-sectional view similar to that depicted in FIG. 6 wherein the templet member 24 as depicted in FIG. 6 has been modified and as therein depicted is referred to as inking templet member 50 which is similar in design to inking templet member 18 of FIG. 5. As discussed in conjunction with inking templet member 18 of FIG. 5, inking templet member 50 provides a means to utilize drafting instrument 10 in conjunction with various inking tasks related to various drafting techniques and functions whereby there is minimized by the construction of inking templet member 50 the inking of a drawing, or the like, in accordance with a particular drafting task. By reducing the distance between the surface of the paper to be inked and the undersurface of the templet member being utilized in conjunction with drafting instrument 10, there is minimized the potential of the improper inking of a drawing.

Reference is now herein made to FIG. 8 which is structurally similar to FIG. 2 and its respective components, the significant changes between the alternative embodiment of said invention as set forth in FIG. 8 as compared to the embodiment set forth in FIG. 2 being the interrelationship between templet member 42 and its mechanical interrelationship with cover plate 43.

More particularly, the structure of cover plate 43 of FIG. 8 is basically identical to that of cover plate 12 as depicted in FIG. 2 except the structure of templet member 42 is such as to provide a concave surface about its perimeter which mechanically interfits and otherwise reacts with ball member 44 which is structurally positioned within the defined cavity existing between the perimeter surface of templet member 42 and cover plate 43.

As depicted in FIG. 8, ball member 44 acts as a "ball bearing" to allow for free rotational movement of templet member 42 about its axis while cover plate 43 provides structural integrity to the overall device.

As a result of the above, there is achieved the overall efficiencies of the invention between utilizing a structural relationship different than that depicted for the device in FIGS. 2 through 7.

Additionally, it should be noted that the distance between the lower surface of templet member 42 and the surface over which same is placed during utilization of the device can be varied in design so as to allow for inking as opposed to utilization of pencil, same being achieved by causing the structure of templet member 42 of FIG. 8 to be similar to that depicted in FIG. 7 of templet member 50.

Reference is herein made to FIG. 9 which evidences another alternative embodiment of the proposed invention wherein a templet member 45 interacts with ball member 46 as related to cover plate 47 much as was described with regard to FIG. 8. The variation in mechanical structure between the invention depicted in FIG. 8 and that depicted in FIG. 9 is the utilization of ball bearing member 48 which provides an additional rotational surface over which templet member 45 moves in conjunction with the utilization and operation of said device.

As depicted in FIG. 9, ball bearing member 48 rides within trough 49 so as to provide reduced frictional contact between templet member 45 and cover plate 47. Additionally, templet member 45 as illustrated in FIG. 9 can additionally be modified in its structure similar to that as depicted in FIG. 7 of templet member 50 therein illustrated so as to allow for a variation in design thereof for purposes of utilizing same for inking as opposed to utilization for pencilled sketches as would be the case as illustrated in FIG. 9.

In keeping with the invention, reference is now made to FIG. 10 wherein there is indicated an alternative embodiment of said invention wherein there is designated an alternative mechanical structure as related to the mechanical interrelationship between a templet member utilized in accordance with the present invention and the base plate of drafting instrument 10 which incorporates said alternative embodiment.

More particularly, as depicted in FIG. 10, base plate 51 is similar to base plate 11 as depicted in FIG. 1 in that there is defined a circular opening defining a center point "0" as depicted in FIG. 1.

As illustrated in FIG. 10 surrounding the circumference of said circular opening having a center point "0" is track member 52 which provides one continuous circular track around the circular opening formed in base plate 51. It should be noted that templet member 53 is constructed so as to form supporting arm 54, supporting arm 54 which extends continuously about the perimeter of templet member 53 so as to evidence an overhanging structural interrelationship with track member 52 such that spool member 55 is axially suspended beneath supporting arm 54 by way of axle member 56 such that spool member 55 is capable of rotational movement about axle member 56. In keeping with the invention, there is envisioned in the preferred embodiment of this alternative embodiment of the invention the utilization of two additional spool members in addition to spool member 55, said spool members being symmetrically positioned about supporting arm 54.

As further indicated in FIG. 10, spool member 55 comes into mechanical contact with track member 52, track member 52 and spool member 55 being designed to as to interact mechanically as between themselves much like the wheel of a train (spool member 55) riding upon a train track (track member 52) as spool member 55 moves around the circumference of the opening formed in base plate 51.

Because templet member 53 is fabricated from any material that will give elasticity and flexibility, such as many of the well known plastics available in the prior art, there is achieved as a result of said elasticity and due to the nature of the overall construction of base plate 51 and templet member 53 as depicted in FIG. 10 the fact that spool member 55 applies a constant force against track member 52, the direction of said force being such as to intersect the center point of templet member 53 with center point "0".

As can be seen with regard to the alternative embodiment depicted in FIG. 10, supporting arm 54 of templet member 53 snaps on in mechanical contact with track member 52 of base plate 51, there being a minimum of at least three such spool members 55 as related to templet member 53, said structure avoiding the necessity of utilizing cover plate 12 as initially depicted in FIG. 1 as related to drafting instrument 10.

In conjunction with FIG. 11 there is depicted an alternative embodiment to the structure set forth in FIG. 10 whereby spool member 55 is replaced by gear member 57, gear member 57 being similar in structure and design to gear member 23 of FIG. 6, there being structurally affixed about gear member 57 a lower pedestal portion 58 and an upper pedestal portion 59, said pedestal portions 58 and 59 being similar to pedestal portions 30 and 30' of FIG. 6, said pedestal portions 58 and 59 interreacting between themselves, gear member 57 and the structure of base plate 60 so as to define a structural channel capable of containing said mechanical interrelationships between base plate 60 and gear member 57 during the utilization of said alternative embodiment of the invention.

In conjunction with the invention, there is illustrated in FIG. 12 a base plate capable of utilization in conjunction therewith and as part of drafting instrument 10, said base plate being generally designated by reference numerical 62. As therein illustrated, base plate 62 has calibrated thereon degree designations so that same can be utilized as a protractor in conjunction with various drafting techniques thereby providing and otherwise enhancing the overall capacities of drafting instrument 10.

Figure 13:
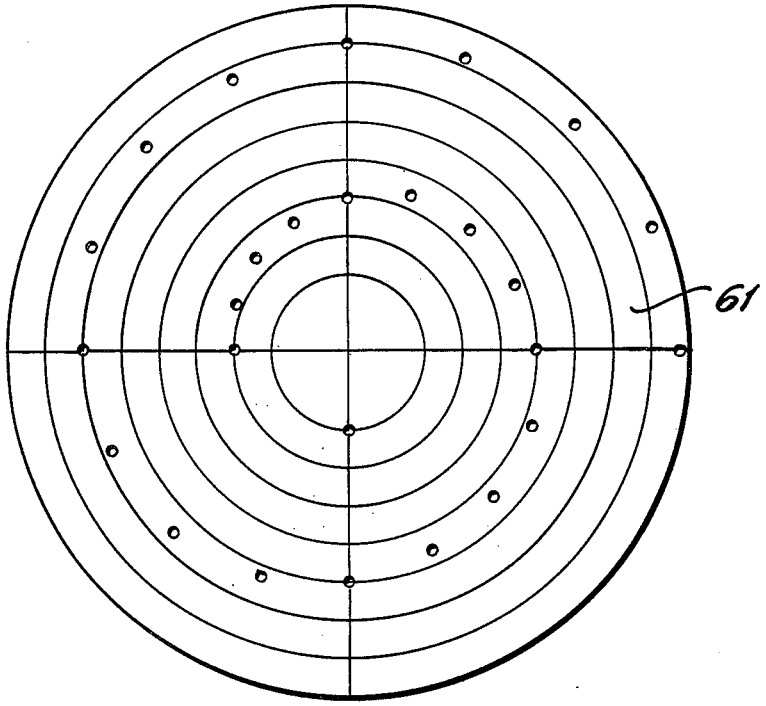
FIG. 13 is a top elevational view of a templet capable of utilization in conjunction with and as part of a drafting instrument constructed in accordance with the invention.

In conjunction with the above, reference is now herein made to FIG. 13 wherein there is depicted a particular design of templet member 16 capable of utilization in conjunction with drafting instrument 10 in accordance with the present invention, same depicting a templet arrangement capable of assisting in the drawing of various sized circles or arch segments, same being designated as templet member 61 as referred to in FIG. 13.

It should be noted that in conjunction with the above, a variety of mechanical interrelationships can be fashioned or otherwise devised to provide for mechanical interfit between a center templet member and the surrounding structure upon which same is designed to freely rotate so as to achieve the overall advantages and design achievements of the present invention. It is in the context of the above, that the above referenced alternative embodiments have been set forth, it, however, being understood that said alternative embodiments are not to be considered limiting in nature, but, should be considered exemplary of variations and not restrictive thereof.

The preceding description and accompanying drawings relate primarily to a specific embodiment of the invention, and the invention in its broader aspect should not be so limited to one specific embodiment as herein shown and described, but departures may be made therefrom within the scope of the accompanying claims without departing from the principals of the invention and without sacrificing its chief advantages.

I claim:

1. A drafting instrument capable of centering a templet at a selected location above a planar surface without the necessity of having a center point pass through the center of said templet into said planar surface for purposes of maintaining the centering of said templet about said center point, wherein said drafting instrument comprises;

(a) A base plate defining a circular opening;

(b) Mounting member assemblies positioned about said circular opening formed through said base plate and structurally affixed to said base plate;

(c) A templet member capable of coming into direct mechanical contact with each of said mounting member assemblies about said templet's circular perimeter in a compressive mechanical interfit such that a force is applied from each of said mounting member assemblies against said templet such that the line of force from each of said mounting member assemblies intersect at a common point;

(d) A cover plate capable of being structurally affixed to said base plate whereby said cover plate and said base plate have cooperating means so as to cause a structural mounting between said base plate and said cover plate of said mounting member assemblies such that said cover plate causes a force to be applied from each of said mounting member assemblies against said templet member.

2. A drafting instrument as set forth in claim 1 above wherein said mounting member assemblies are symmetrically positioned about the opening formed through said base plate.

3. A drafting instrument as set forth in claim 1 above wherein said mounting member assemblies comprise a pulley member axially mounted between said cover plate and said base plate so as to allow for the rotational movement of said pulley member about its axis, said pulley member being structurally positioned so as to be in mechanical interfit with said templet member.

4. A drafting instrument as set forth in claim 1 above wherein said cover plate comprises three separate and distinct component parts.

5. A drafting instrument as set forth in claim 4 above wherein said cover plate comprises four separate and distinct component parts.

6. A drafting instrument as set forth in claim 4 above wherein said cover plate comprises five separate and distinct component parts.

7. A drafting instrument as set forth in claim 3 above wherein said pulley member defines a toothed gear structure capable of having said gear teeth of said pulley member mesh with said templet member wherein said templet member also defines about its circumference a toothed gear structure.

* * * * *